US006633213B1

(12) United States Patent
Dove

(10) Patent No.: US 6,633,213 B1
(45) Date of Patent: Oct. 14, 2003

(54) DOUBLE SIDED LIQUID METAL MICRO SWITCH

(75) Inventor: Lewis R Dove, Monument, CO (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 10/128,849

(22) Filed: Apr. 24, 2002

(51) Int. Cl.[7] ..... H01H 51/22
(52) U.S. Cl. ..... 335/78; 335/47
(58) Field of Search ..... 335/47, 57, 58, 335/50, 51–56, 78; 200/233, 234, 235, 192, 193; 361/704, 700, 699

(56) References Cited

U.S. PATENT DOCUMENTS 5,912,606 A * 6/1999 Nathason et al. ..... 335/47
6,304,450 B1 * 10/2001 Dibene, II et al. ..... 361/704
6,396,371 B2 * 5/2002 Streeter et al. ..... 335/78

* cited by examiner

*Primary Examiner*—Tuyen T. Nguyen
(74) *Attorney, Agent, or Firm*—Edward L. Miller

(57) ABSTRACT

A plurality of Liquid Metal Micro Switches (LIMMS) are mounted on opposite sides of a multi-layer substrate. Vias on the substrate and located within the footprints of the LIMMS serve to make connection with the LIMMS. Traces on the internal layers of the multi-layer substrate are routed around and over each other to arrive at a perimeter surrounding the LIMMS, where they emerge again as vias and are available for interconnection with further circuitry via conventional techniques, such as solder balls, wire bonding, a socket, etc. The multi-layer substrate may also incorporate a ground plane to assist in shielding and the fabrication of any interconnecting transmission lines.

3 Claims, 4 Drawing Sheets

DOUBLE SIDED LIQUID METAL MICRO SWITCH

REFERENCE TO RELATED PATENT

The subject matter of this Application is related to that disclosed in U.S. Pat. No. 6,323,447 B1 entitled ELECTRICAL CONTACT BREAKER SWITCH, INTEGRATED ELECTRICAL CONTACT BREAKER SWITCH, AND ELECTRICAL CONTACT SWITCHING METHOD, issued Nov. 27, 2001. The subject matter described in the instant Application is a refinement and further application of the subject matter of U.S. Pat. No. 6,323,447 B1, and for brevity in the description herein of background technology used as a point of departure, U.S. Pat. No. 6,323,447 B1 is hereby expressly incorporated herein by reference, for all that it discloses.

BACKGROUND OF THE INVENTION

Although many semiconductor devices are called "switches," and although those devices are used in many circuit applications to perform the electrical connection functions of a traditional metal-to-metal moving contact structure, it is still the case that for a variety of reasons (e.g., ability to carry high currents, high break-down voltages, high isolation, operation in an AC circuit, etc.) a genuine traditional switch is the component of choice. Of course, the term "switch" is broader than the simple class of devices that are operated by a human hand or finger, or by some mechanical linkage to an object such as a door, cockpit canopy or a float, and the term includes what are ordinarily called "relays." A relay is a switch that is (usually) operated by an electrical signal that is converted (e.g., by a magnetic coil) to mechanical motion that operates the switch. Common relays incorporate a spring tension to return the contacts to an un-operated state in the absence of the electrical signal. On the other hand, some relays have actuation mechanisms that transition from one stable state to another stable state, and that stay transitioned in the absence of, or after the removal of, the signal that produced the change in state. Such relays are called "latching" relays.

Among the reasons for preferring a genuine moving contact switch to one of its semiconductor counterparts is the need for preserving the characteristic impedance of a transmission line that must be switched among other components (attenuators, power splitters, etc.), or the need for simple shielding in a less demanding situation of a conductor that is only shielded, but that is not an actual transmission line having a controlled characteristic impedance. "Coaxial switch" is the term usually given to this sort of structure, and various instances of this sort of thing are produced as relays also, in both latching and non-latching versions. True coaxial relays are an exercise in electro-mechanical fidelity to the transmission line that they are to connect to. They are not small, and they are not inexpensive. They wear out, their contacts oxidize or deform, and their behavior can become erratic. But most of all, they are "big" and are unsuitable for use in many applications involving integrated circuitry, including the assembly of integrated system components onto a substrate to form a "hybrid" circuit. We simply can't bring ourselves to use a relay whose volume is ten to even a thousand times that of the circuitry it is supposed to switch, let alone use several such relays!

On the other hand, if a genuine metal-to-metal switching mechanism is small enough, then below some upper frequency it can largely avoid the evils of a temporary (think: "small") discontinuity or lapse in shielding, even though it is not itself a coaxial structure. This is follows from the well appreciated fact that when the physical size of the departure from ideal geometry is small compared to the shortest wavelength present, then the resulting discontinuity is essentially invisible, or at least tolerable. This is a long way of saying that if we have a genuine switch that is small enough, we may well be able to use it in place of a much larger coaxial switch, even though the small switch is not truly a segment of a transmission line structure. The same goes for shielding, although that is often easier to supply, since it does not have the worry of maintaining a characteristic impedance that is strongly influenced by geometry. And equally as valuable, such a small relay would be of a size that is comparable to, or maybe even a little smaller than, the circuit elements it is to switch among, and the whole works can be fabricated on a substrate as a hybrid. We have just called such a thing a relay, rather than a switch, since at the sizes we are interested in (say, one tenth inch by one tenth inch) it is most unlikely that such a switch would have a bat handle, lever or other mechanical linkage through which it is to be operated. In times past such a relay was fanciful, but that is no longer so.

Recent developments have occurred in the field of very small switches having liquid moving metal-to-metal contacts. With reference to FIGS. 1–4, we shall briefly sketch the general idea behind one class of these devices. Having done that, we shall advance to the topic that is most of interest to us, which is a technique for fabricating on a hybrid substrate dense collections of such relays. (Henceforth we shall, as is becoming customary, refer to such a switch as a Liquid Metal Micro Switch, or LIMMS.)

Refer now to FIG. 1A, which is a top sectional view of certain elements to be arranged within a cover block 2 of suitable material, such as glass. The cover block 2 has within it a closed-ended channel 1 in which there are two small movable distended droplets (10, 11) of a conductive liquid metal, such as mercury. The channel 1 is relatively small, and appears to the droplets of mercury to be a capillary, so that surface tension plays a large part in determining the behavior of the mercury. One of the droplets is long, and shorts across two adjacent electrical contacts extending into the channel, while the other droplet is short, touching only one electrical contact. There are also two cavities 6 and 7, within which are respective heaters 4 and 5, each of which is surrounded by a respective captive atmosphere (15, 16) of an inert gas, such as $CO_2$. Cavity 4 is coupled to the channel 1 by a small passage 8, opening into the channel 1 at a location about one third or one fourth the length of the channel from its end. A similar passage 9 likewise connects cavity 5 to the opposite end of the channel. The idea is that a temperature rise from one of the heaters causes the gas surrounding that heater to expand, which splits and moves a portion of one of the mercury droplets, forcing it to join the short droplet. This forms a complementary physical configuration (or mirror image), with the large droplet now at the other end of the channel. This, in turn, toggles which two of the three electrical contacts are shorted together. After the change the heater is allowed to cool, but surface tension keeps the mercury droplets in their new places until the other heater heats up and drives a portion of the new long droplet back the other way. Since all this is quite small, it can all happen rather quickly; say, on the order of milliseconds.

To continue, then, refer now to FIG. 1B, which is a sectional side view of FIG. 1A, taken through the middle of the heaters 4 and 5. New elements in this view are the bottom substrate 3, which may be of a suitable ceramic material, such as that commonly used in the manufacturing of hybrid circuits having thin film, thick film or silicon die components. A layer 17 of sealing adhesive bonds the cover block 2 to the substrate 3, which also makes the cavities 4 and 5, passages 8 and 9, and the channel 1, all gas tight (and also mercury proof, as well!). Layer 17 may be of a material called CYTOP (a registered trademark of Ashai Glass Co., and available from Bellex International Corp., of Wilmington, Delaware).

Also newly visible are vias 18–21 which, besides being gas tight, pass through the substrate 3 to afford electrical connections to the ends of the heaters 4 and 5. So, by applying a voltage between vias 18 and 19, heater 4 can be made to become very hot very quickly. That in turn, causes the region of gas 15 to expand through passage 8 and begin to force long mercury droplet 10 to separate, as is shown in FIG. 2. At this time, and also before heater 4 began to heat, long mercury droplet 10 physically bridges and electrically connects contact vias 12 and 13, after the fashion shown in FIG. 1C. Contact via 14 is at this time in physical and electrical contact with the small mercury droplet 11, but because of the gap between droplets 10 and 11, is not electrically connected to via 13.

Refer now to FIG. 3A, and observe that the separation into two parts of what used to be long mercury droplet 10 has been accomplished by the heated gas 15, and that the right-hand portion (and major part of) the separated mercury has joined what used to be smaller droplet 11. Now droplet 11 is the larger droplet, and droplet 10 is the smaller. Referring to FIG. 3B, note that it is now contact vias 13 and 14 that are physically bridged by the mercury, and thus electrically connected to each other, while contact via 12 is now electrically isolated.

The LIMMS technique described above has a number of interesting characteristics, some of which we shall mention in passing. They make good latching relays, since surface tension holds the mercury droplets in place. They operate in all attitudes, and are reasonably resistant to shock. Their power consumption is modest, and they are small. They have decent isolation, are reasonably fast with minimal contact bounce. There are versions where a piezo-electrical element accomplishes the volume change, rather than a heated and expanding gas. There are also certain refinements that are sometime thought useful, such as bulges or constrictions in the channel or the passages. Those interested in such refinements are referred to the Patent literature, as there is ongoing work in those areas. See, for example, the incorporated U.S. Pat. No. 6,323,447 B1.

To sum up our brief survey of the starting point in LIMMS technology that is presently of interest to us, refer now to FIG. 4. There is shown an exploded view of a slightly different arrangement of the parts, although the operation is just as described in connection with FIGS. 1–3. In particular note that in this arrangement the heaters (4, 5) and their cavities (6, 7) are each on opposite sides of the channel 1.

Now consider the underside of the substrate 3. For a SPDT switch it will have a pattern of seven vias thereon, or perhaps six if there is a trace on the substrate connecting two of the heater terminals in common. (A SPST device might have a few as five, or as many as six.) It is through these vias (not shown, but it is clear that they are there and where they are) that connection is made to the LIMMS of FIG. 4. Now suppose that we desire to deploy many LIMMS in a small space, or perhaps only few LIMMS, but as closely together as possible, say, owing to routing considerations for microwave signals. There are also shielding and transmission line considerations, all of which suggest that a ground plane is desirable. In addition, we'd like to be able to treat such a collection of LIMMS devices as a unit assembly. What to do?

SUMMARY OF THE INVENTION

A solution to the problem of locating a plurality of Liquid Metal Micro Switches (LIMMS) on a substrate and in a minimal amount of space is to mount them on opposite sides of a multi-layer substrate. Vias on the substrate and located within the footprints ofthe LIMMS serve to make connection with the LIMMS. Traces on the internal layers of the multi-layer substrate are routed around and over each other to arrive at a perimeter surrounding the LIMMS, where they emerge again as vias and are available for interconnection with further circuitry via conventional techniques, such as solder balls, wire bonding, a socket, etc. The multi-layer substrate may also incorporate a ground plane to assist in shielding and the fabrication of any interconnecting transmission lines.

DESCRIPTION OF A PREFERRED EMBODIMENT

Figure 1A:
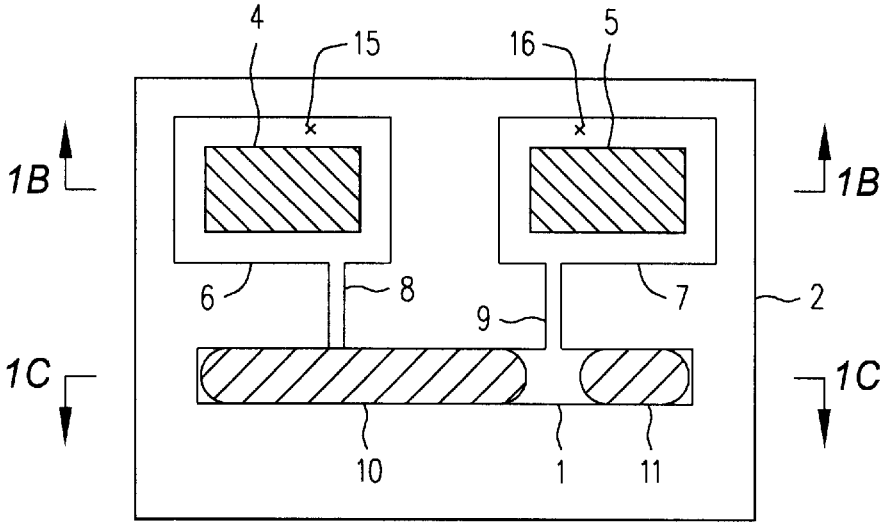
FIG. 1A PRIOR ART
FIGS. 1A–C are various sectional views of a prior art SPDT Liquid Metal Micro Switch (LIMMS), and wherein for convenience, while the heaters are shown as located on opposite ends of the channel, they are also shown as being on the same side thereof.
Figure 1B:
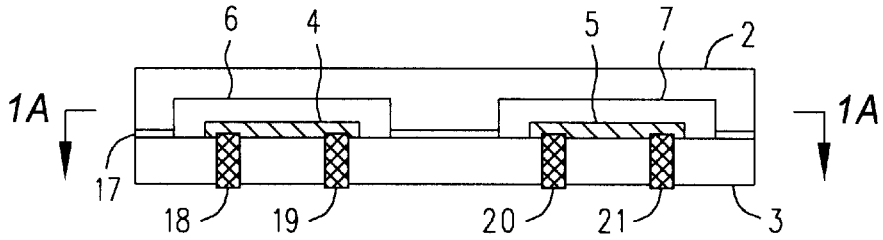
FIG. 1B PRIOR ART
Figure 1C:
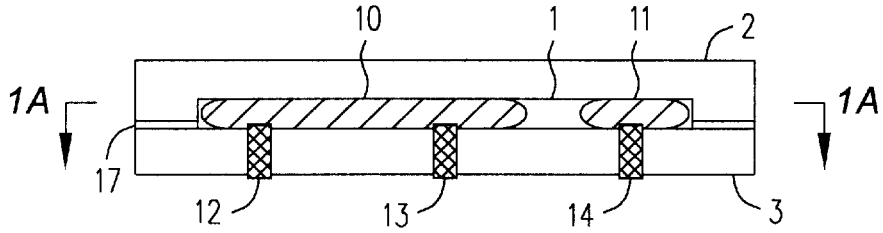
FIG. 1C PRIOR ART
Figure 2:
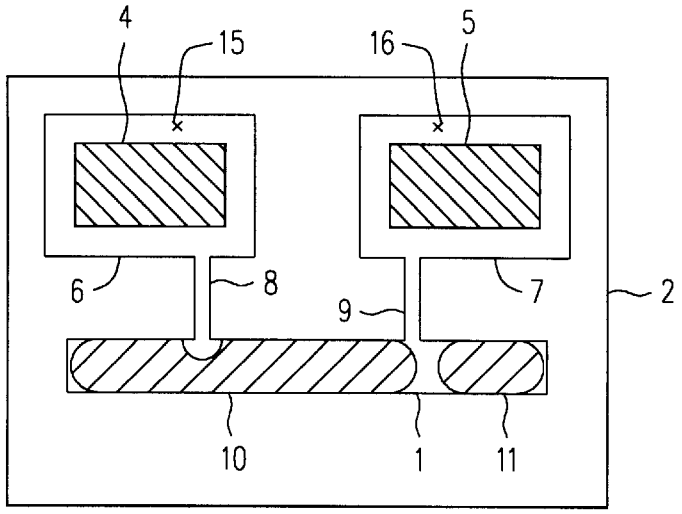
FIG. 2 PRIOR ART
FIG. 2 is a sectional view similar to that of FIG. 1A, at the start of an operational cycle.
Figure 3A:
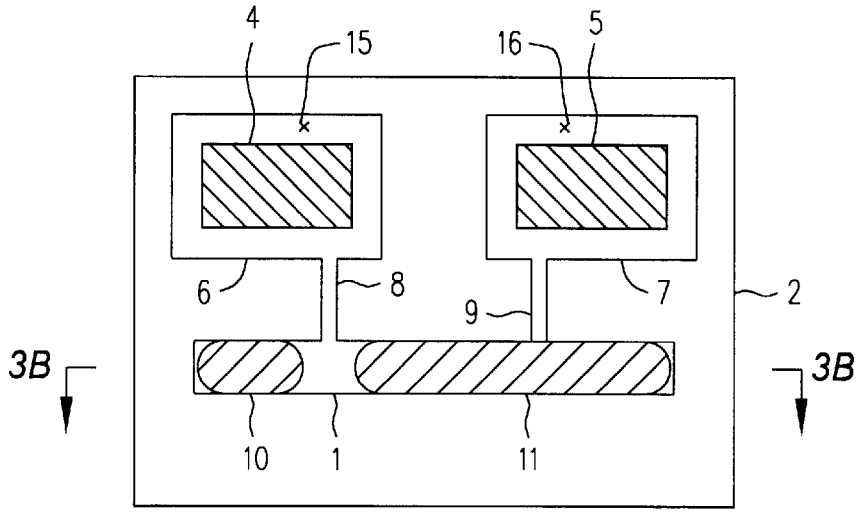
FIG. 3A PRIOR ART
FIGS. 3A–B are sectional view of the LIMMS of FIGS. 1A–C at the conclusion of the operation begun in FIG. 2.
Figure 3B:
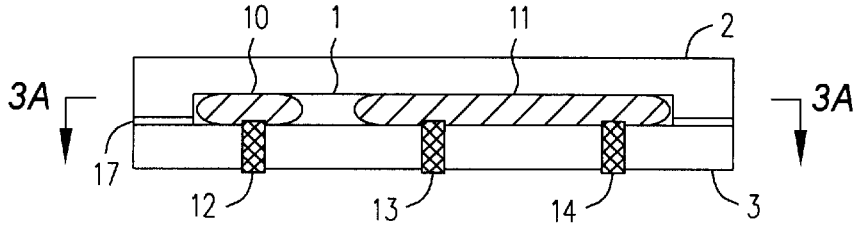
FIG. 3B PRIOR ART
Figure 4:
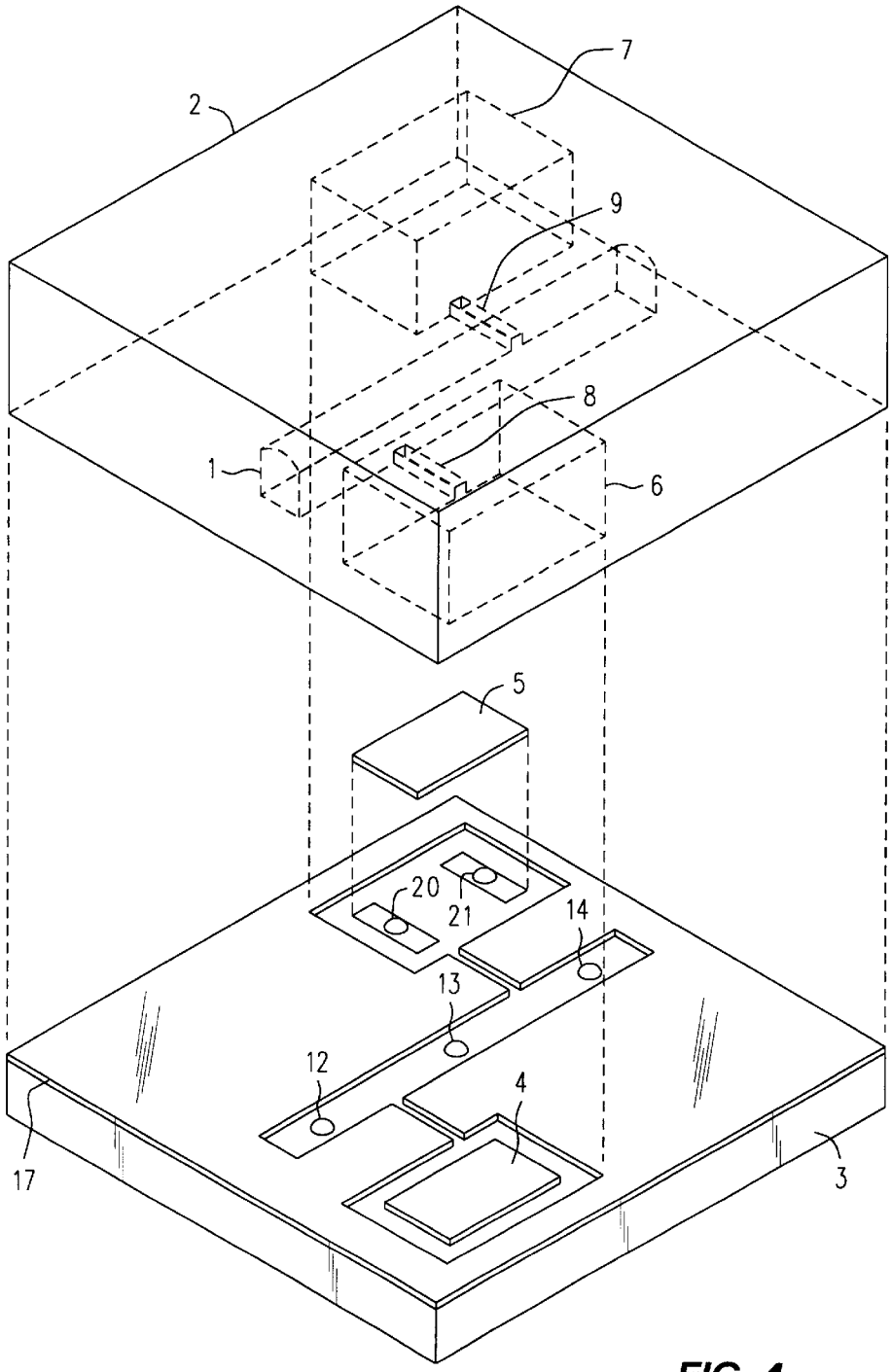
FIG. 4 PRIOR ART
FIG. 4 is an exploded view of a SPDT LIMMS similar to what is shown in FIGS. 1–3, but where the heaters are disposed on both opposite sides and on opposite ends of the channel.
Figure 5:
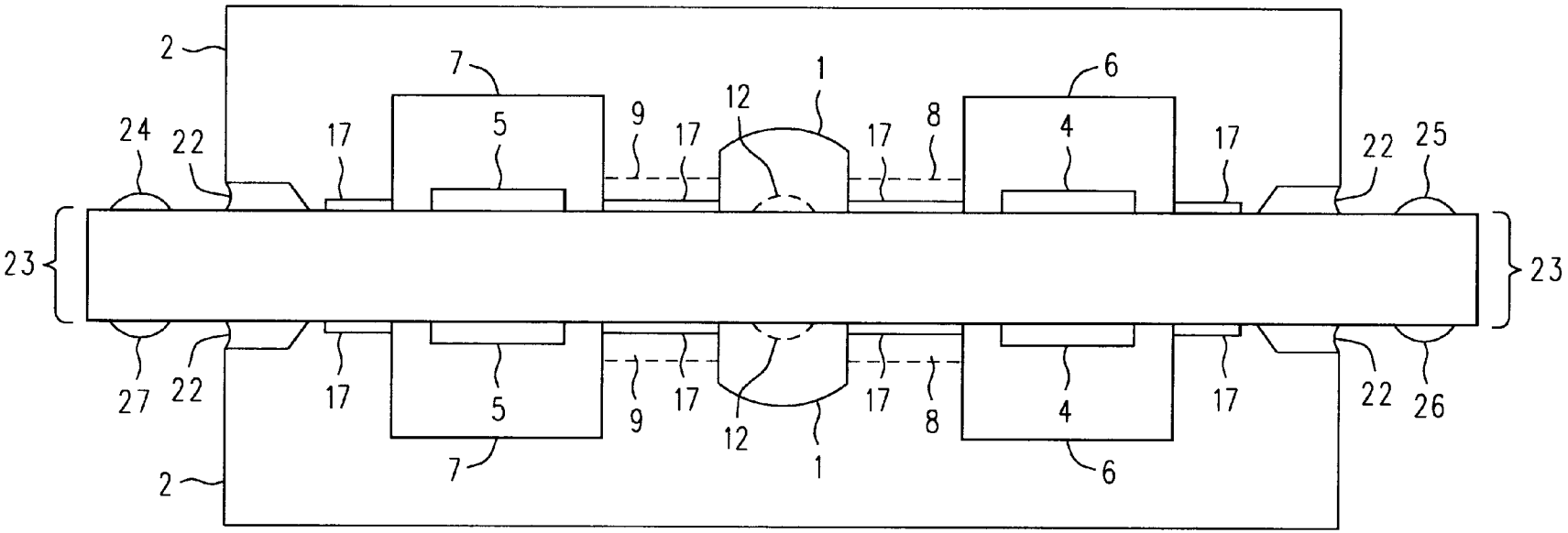
FIG. 5 is a simplified side cut-away view of multiple LIMMS fabricated upon both sides of a multi-layer substrate.

Refer now to FIG. 5, wherein is shown a cut-away side view of two LIMMS mounted on opposite sides of a multi-layer substrate 23. In each LIMMS, of which there is an upper one and a lower one, the reference numerals corresponding to like elements appearing in previous figures retain their original values. As far as the LIMMS themselves are concerned, the only new fabrication detail involves further sealing of the cover blocks 2 against the substrate (which used to be 3, but is now 23). To this end a slight recess has been formed around the edge of the cover block surface that will contact the substrate, and the exposed surface ofthe recess is metalized (a process known in itself) with a metal that will wet with solder. A corresponding metal pattern (e.g., an outline of the LIMMS footprint in gold, and which is not shown) is formed on the substrate opposite the recess, and serves as a place on the substrate for the solder to adhere. Thus, the cover blocks 2 are gasketed by the CYTOP seal material 17, while also being firmly held mechanically in place by a solder joint 22 between the metalized recess and the gold footprint outline. The solder joint 22 also provides a good hermetic seal. It will be appreciated that the vias that are on the under side of the LIMMS (say, five to seven for each device), and that face the substrate 23, are also electrically connected to a corresponding pattern of vias on the substrate. These sets of vias are soldered to each other at the same time that solder joint 22 is formed, in a manner that is known in itself.

Now consider the two LIMMS shown in FIG. 5 (and the number two, one on top and one on the bottom, is merely exemplary—it could any number on top and any other number on the bottom). For each LIMMS on the top side of the multi-layer substrate 23 there are, say, five to seven traces that need to be routed among themselves and to the external environment. If there is a large nest of LIMMS on one side of the substrate, then that can be a significant trace routing problem, which may be complicated by serial or parallel connections between the heaters, and by whatever interconnections are needed between the poles of the switches themselves are needed to form the desired switching upon the work signals to be switched. This is made all the more complicated by the presence of another nest of LIMMS on the other side of the substrate 23. However, printed circuit board trace routing techniques have been applied to multi-layer ceramic substrates, the use of vias to shift a trace to another layer to cross another trace is understood. It is these techniques that we will use to rout the traces connected to the LIMMS.

As to the number of layers, increasing the number of LIMMS and the complexity of interconnection therebetween will indicate that more layers are needed, up to some practical limit encountered for expense and yield. On the other hand, it seems fair to say that the minimum number of layers is three. The outer surface of each of the two outside substrate layers is generally not available for routing of traces visiting the LIMMS, as the solder joint 22 bars the path. The opposite surfaces of those two outside substrates can carry traces, but need to be separated by some intervening layer to keep the traces from touching each other. That leads to a third layer of ceramic or other substrate layer material. If a ground plane were needed, then it could be provided on yet another internal layer, or on the outer surfaces of the one or both of the outside substrate layers.

Once the LIMMS are hooked up to each other by the conductors within the multi-layer substrate 23, they (or at least some of them will) need to be connected to circuitry in the external environment. Those traces are routed toward some periphery, or other convenient location upon that portion of the multi-layer substrate extending away from the nest of LIMMS, where however many necessary vias (24–27) emerge on either side of the multi-layer substrate. These vias 24–27 represent the various signals that are to be connected to or from the external environment. The actual manner of interconnection can be conventional, and includes but is not limited to, solder balls, bonding wires, sockets, pins, etc. It could even be soldered in place.

I claim:

1. A switching circuit assembly comprising:

a first LIMMS having a first mounting surface upon which is a first pattern of electrical contacts;

a second LIMMS having a second mounting surface upon which is a second pattern of electrical contacts;

a multi-layer substrate having a first outer surface upon which the first mounting surface of the first LIMMS is mounted and an opposing second outer surface upon which the second mounting surface of the second LIMMS is mounted;

the first outer surface having a pattern of vias that matches the first pattern of electrical contacts and that are connected thereto when the first LIMMS is mounted to the first outer surface;

the second outer surface having a pattern of vias that matches the second pattern of electrical contacts and that are connected thereto when the second LIMMS is mounted to the second outer surface; and the multi-layer substrate having internal layers upon which are traces that interconnect the patterns of vias on the first and second outer surfaces with a pattern of connecting terminals that are disposed along a periphery of the multi-layer substrate and that are for interconnecting the switching circuit assembly with an external electrical environment that uses the switching provided by the switching circuit assembly.

2. A switching circuit assembly as in claim 1 wherein one of the fist and second outer surfaces includes a ground plane.

3. A switching circuit assembly as in claim 1 wherein one of the internal layers includes a ground plane.

* * * * *